US012631329B2

(12) United States Patent
Billings, Jr. et al.

(10) Patent No.: US 12,631,329 B2
(45) Date of Patent: May 19, 2026

(54) CONICAL FUEL PARTICULATE DISTRIBUTOR FOR COAL SUPPLY CONDUIT

(71) Applicant: SAS GLOBAL CORPORATION, Warren, MI (US)

(72) Inventors: David Allen Billings, Jr., Garden City, MI (US); Justin James-Paul Bennett, Novi, MI (US); Kevin Raymond Kleist, Macomb, MI (US)

(73) Assignee: SAS GLOBAL CORPORATION, Warren, MI (US)

( * ) Notice: Subject to any disclaimer, the term of this patent is extended or adjusted under 35 U.S.C. 154(b) by 555 days.

(21) Appl. No.: 18/226,487

(22) Filed: Jul. 26, 2023

(65) Prior Publication Data

US 2024/0337383 A1 Oct. 10, 2024

Related U.S. Application Data

(63) Continuation-in-part of application No. 18/296,773, filed on Apr. 6, 2023, now abandoned.

(51) Int. Cl.
*F23K 3/02* (2006.01)

(52) U.S. Cl.
CPC ..... *F23K 3/02* (2013.01); *F23K 2203/002* (2013.01); *F23K 2203/006* (2013.01); *F23K 2203/201* (2013.01)

(58) Field of Classification Search
CPC ..... F23K 3/02; F23K 2203/201; B02C 23/10
See application file for complete search history.

(56) References Cited

U.S. PATENT DOCUMENTS 1,736,903 A * 11/1929 De Lorenzi ..... F23D 1/00 110/104 B
1,740,985 A * 12/1929 Irish ..... F23D 1/00 431/185
2,335,188 A * 11/1943 Kennedy ..... F23D 17/00 431/185
4,634,054 A * 1/1987 Grusha ..... F23D 1/00 239/522
5,388,536 A * 2/1995 Chung ..... F23D 1/02 239/502
6,439,136 B1 * 8/2002 Mann ..... F23D 1/00 239/DIG. 19
6,899,041 B2 * 5/2005 Wark ..... F23K 3/02 110/106
2009/0272822 A1 * 11/2009 Davis ..... F23D 1/00 239/502
2011/0127355 A1 * 6/2011 Tamura ..... F23C 7/004 239/403
2023/0288061 A1 * 9/2023 Ishii ..... F23D 1/00

* cited by examiner

*Primary Examiner* — David J Laux
(74) *Attorney, Agent, or Firm* — Young Basile Hanlon & MacFarlane, P.C.

(57) ABSTRACT

A conical cylindrical distributor for particulate coal being fed from a mill/pulverizer to a combustion chamber has concentric, vaned flow channels terminating in dentillated plated extending partially across the flow paths directly at the outlet ends thereof to create turbulence and particle impact to better supply the combustion chamber with a uniform mixture of coal particles.

10 Claims, 8 Drawing Sheets

CONICAL FUEL PARTICULATE DISTRIBUTOR FOR COAL SUPPLY CONDUIT

CROSS-REFERENCE TO RELATED APPLICATION

This application is a continuation in part of U.S. patent application Ser. No. 18/296,773 filed Apr. 6, 2023, the entire disclosure of which is hereby incorporated by reference.

TECHNICAL FIELD

This disclosure describes a particulate distributor, sometimes called a "mixer", for a coal supply conduit transferring pulverized coal from a mill/pulverizer to the combustion chamber of a coal-fired boiler.

BACKGROUND

Combustion chambers for turbine generator boilers used to produce electricity are commonly fed with particulate coal from a crusher/pulverizer/classifier that may have several branches feeding the combustion chamber. The branches preferably carry equal coal flow rates to stabilize the fireball in the combustion chamber.

SUMMARY

Disclosed herein are implementations of a particulate distributor or "mixer" for pulverized coal flowing from a crusher/pulverizer to a combustion chamber. U.S. Pat. No. 6,899,041 issued May 31, 2005 to Ricky E. Wark shows a distributor having an arrangement of concentric cylindrical flow paths with vanes to produce a mixed rotating particle flow. The implementations disclosed herein improve on that distributor concept so as to provide improved mixing and diffusion action within a well-defined and compact volume. The preferred implementation involves forming the distributor body in a conical/tapered shape to produce flow acceleration and easier installation and servicing. The distributor may be further improved through the addition of a diffuser structure involving the installation of plate members in the flow paths at the outlet points to produce turbulence through impact of the airborne particles with the plate members. These members are preferably mounted such as by welding directly on the surfaces of the vanes in the flow channels at the outlet points thereof. These novel additions, taken alone or in combination, produce a more homogenous mixture of air and coal while maximizing the mixing and distribution in a single ideal location or plane. The implementations described herein provide a single unit that facilitates installation and maintenance and improves performance.

As opposed to the design of the mixer disclosed in U.S. Pat. No. 6,899,041 where a turbulence generating structure 48, 53 is mounted above the distributor/mixer output, the diffuser structure disclosed herein mounts an arrangement of dentillated plates directly into the distributor structure itself so as to reside in the concentric flow paths at the upper/outlet ends thereof. The particles impact these plates before leaving the distributor and the impact and turbulence caused by the impact improves the quality of coal particles being fed to the combustion chamber. The diffuser plates work well with the tapered distributor body shape to produce improved performance of the crusher mill/pulverizer as described above.

Exemplary implementations of a particulate distributor for pulverized coal flowing to a combustion chamber are described herein to have an inner cylinder, an outer cylinder concentric with the inner cylinder, an intermediate cylinder concentric with the inner cylinder, a first flow channel defined between the inner cylinder and the intermediate cylinder, the first flow channel having first vanes each extending between and attached to the inner cylinder and the intermediate cylinder, a second flow channel defined between the intermediate cylinder and the outer cylinder, the second flow channel having second vanes each extending between and attached to the outer cylinder and the intermediate cylinder, and an outlet distributor attached at an outlet structure side of the particulate distributor. The preferred embodiment, however, includes a distributor/mixer body that is tapered smoothly or in one or more steps to reduce the cross sectional area of the flow channels at the outlets relative to the inputs and adds a diffuser structure including plates of abrasive resistant material welded into the flow channel outlets with opposed longitudinal edges having uniformly spaced teeth formed therein, the teeth extending into and partially across at least one of the flow channels thereby forming impingement surfaces around the at least one circular flow channel. Using the plates in all three channels is preferred.

Other variations in the disclosed implementations will become apparent to those skilled in the art when the following description is read in conjunction with the accompanying drawings.

BRIEF DESCRIPTION OF THE DRAWINGS

The disclosure is best understood from the following detailed description when read in conjunction with the accompanying drawings. In general, the drawings of the assembled structures are to scale and example dimensions are given in the detailed description.

DETAILED DESCRIPTION

Figure 1:
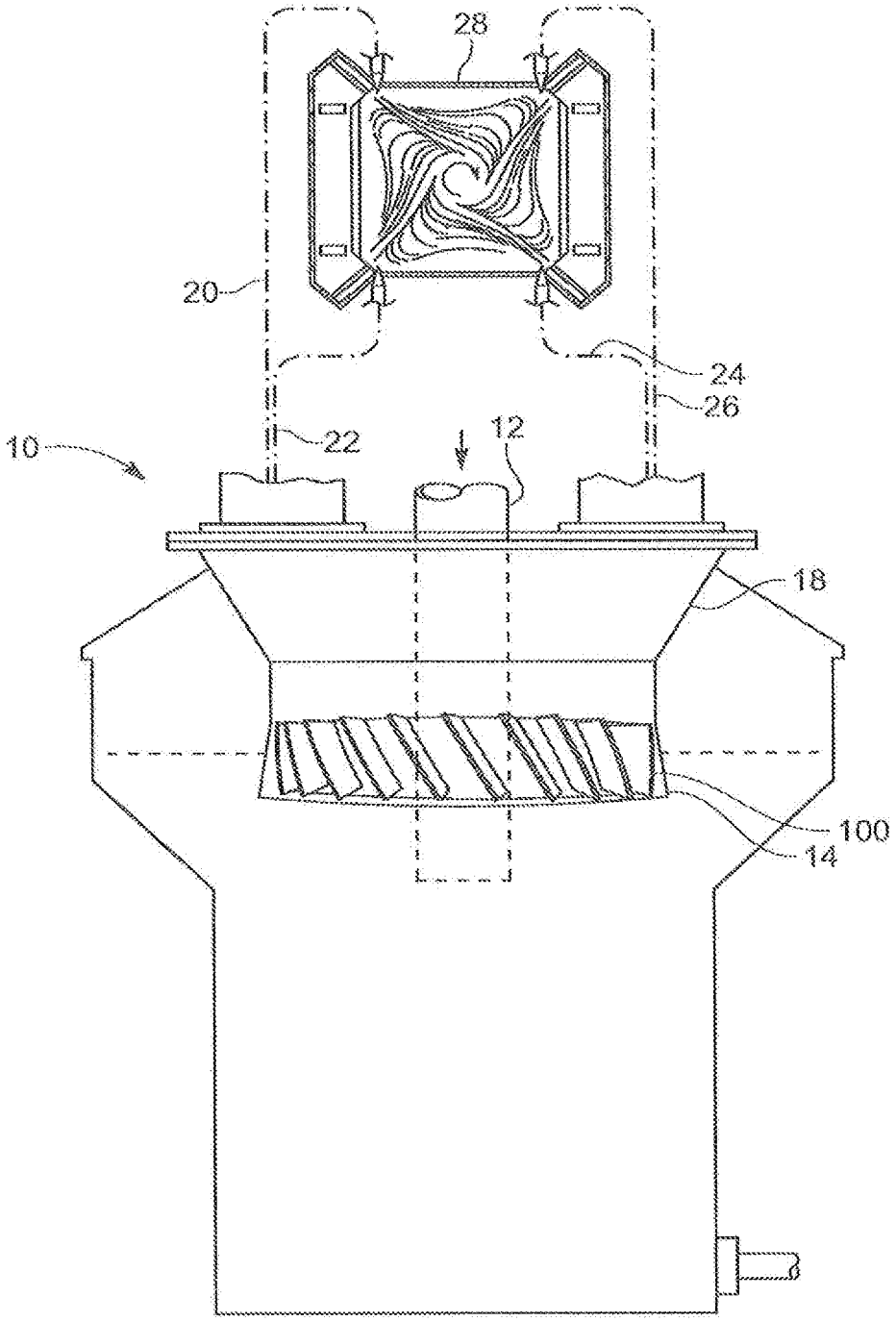
FIG. 1 is diagram of a system for supplying pulverized and classified airborne particulate coat to a combustion chamber.
Figure 2:
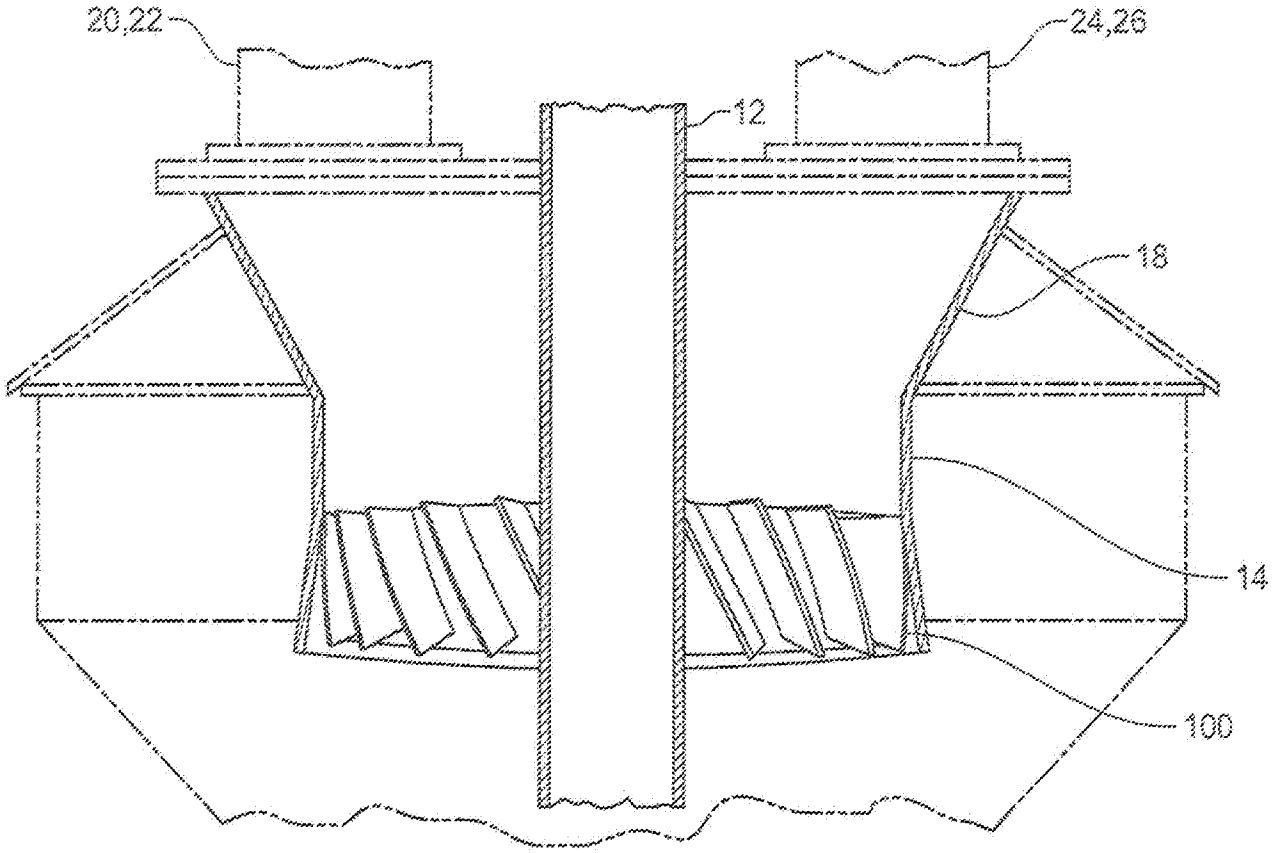
FIG. 2 is an enlarged cross-section through the outlet supply conduit and particulate distributor.

Referring to FIGS. 1 and 2, a conventional coal mill/pulverizer/classifier 10 has a vertical downflow coal inlet supply conduit 12 centrally and vertically positioned for feeding lump coal into the pulverizer/classifier 10 in controlled quantities. The mill/pulverizer/classifier 10 has a main outlet supply conduit 14 which, in the illustrated coal mill/pulverizer/classifier 10, is concentric with the coal inlet supply conduit 12 but substantially larger in diameter. Some mill/pulverizers/classifiers may have side feed features in which case the coal inlet supply conduit 12 may serve as a center outflow channel with or without vanes. Alternatively, with a side feed feature, the coal inlet supply conduit 12 is non-existent or blocked off. The outlet supply conduit 14 merges into a frustoconical transition section 18 which acts as a manifold to supply airborne particulate coal to four parallel branch conduits 20, 22, 24, 26 which may be arranged as illustrated to supply the four corners of a combustion chamber 28 which is associated with a boiler for supplying steam to the turbine of an electrical power generator, for example. The transition section 18 may alternatively be straight-sided, i.e., substantially cylindrical. Four branch conduits are illustrated, but the number may vary. In operation, lump coal is gravity fed through the coal inlet supply conduit 12 to the mill/pulverizer/classifier 10 which operates in a conventional fashion. Pulverized coal is carried upwardly in an air stream through the outlet supply conduit 14 before entering the four parallel branch conduits 20, 22, 24 and 26, which in turn supply the four corners of the combustion chamber 28 or "firebox" of the turbine boiler.

Mechanically pulverizing coal into a powder enables it to be sprayed into the combustion chamber in a fluidic and uniform fashion and burned more efficiently. The coal particles are entrained in air. Because the pulverized coal has more surface area per unit weight than larger coal particles, more surface area is exposed to heat and oxygen. The combustion reaction occurs at a faster rate, requiring less air for complete combustion. An increasing demand for higher efficiency always exists, and improvements to the distribution and homogeneousness of the coal particulate can help to meet the demand.

Disclosed herein are implementations of a particulate coal distributor 100 for use in the outlet supply conduits 14 of a mill/pulverizer/classifiers 10. The particulate distributor provides a combination of mixing designs into a single unit to promote improved diffusion action within a more defined and compact area of the outlet supply conduit 14. The particulate distributor 100 induces additional impact of the air/particle mixture with parts of the distributor to improve particle pulverization and distribution, accelerating a homogenous mixture of air and fuel while maximizing the mixing and distribution in a single, ideal location or plane inside the outlet supply conduit 14. Containing the blending of the coal and air to a single, lower location can prevent disturbances caused by isolation swing valves.

In addition to the improvements in particle distribution and homogenous air/particulate mixtures, the particulate distributors disclosed herein provide a combination of mixers/distributors in a single unit that improves installation and maintenance, making them easier to perform and safer. The conical shape of some of the disclosed particulate distributors shown herein allow for maintenance access on mill isolation components. Further, the conical shape lowers the differential pressure across the distributor and improves flow of the air/coal particulate stream.

An implementation of a particulate distributor 100 according to the present invention is illustrated in FIGS. 3-6. The particulate distributor 100 is mounted in the outlet supply conduit 14 of the mill/pulverizer/classifier 10 with flanges or other mechanical assemblies known to those skilled in the art. The mountings should not obstruct the flow of the air/coal particulate mixture.

Figure 4:
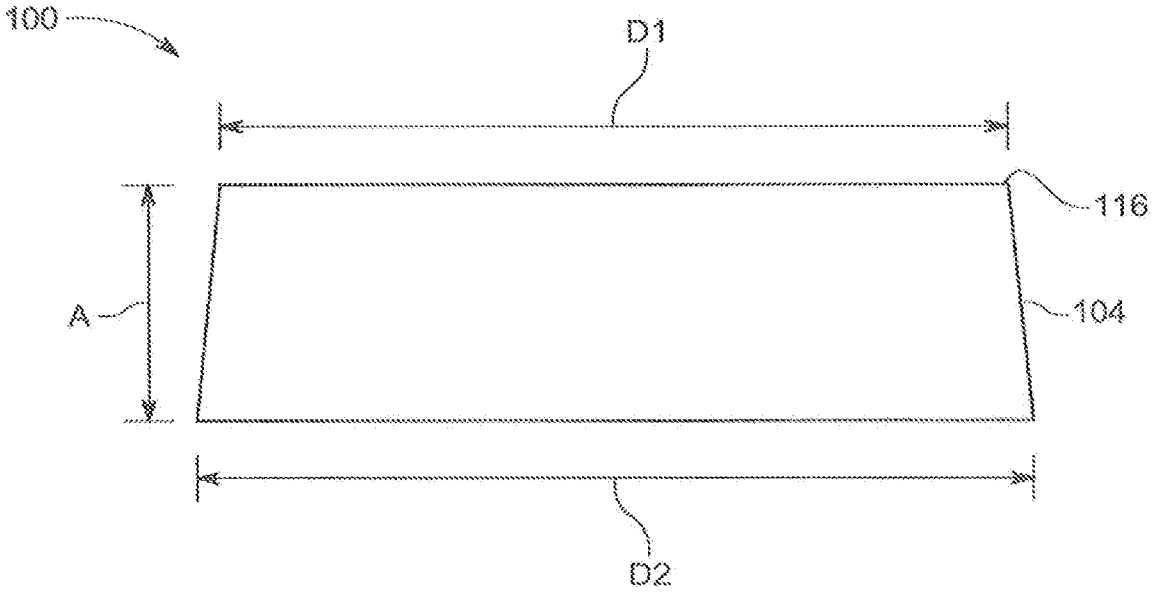
FIG. 4 is a side view of the implementation of the particulate distributor of FIG. 3.
Figure 4A:
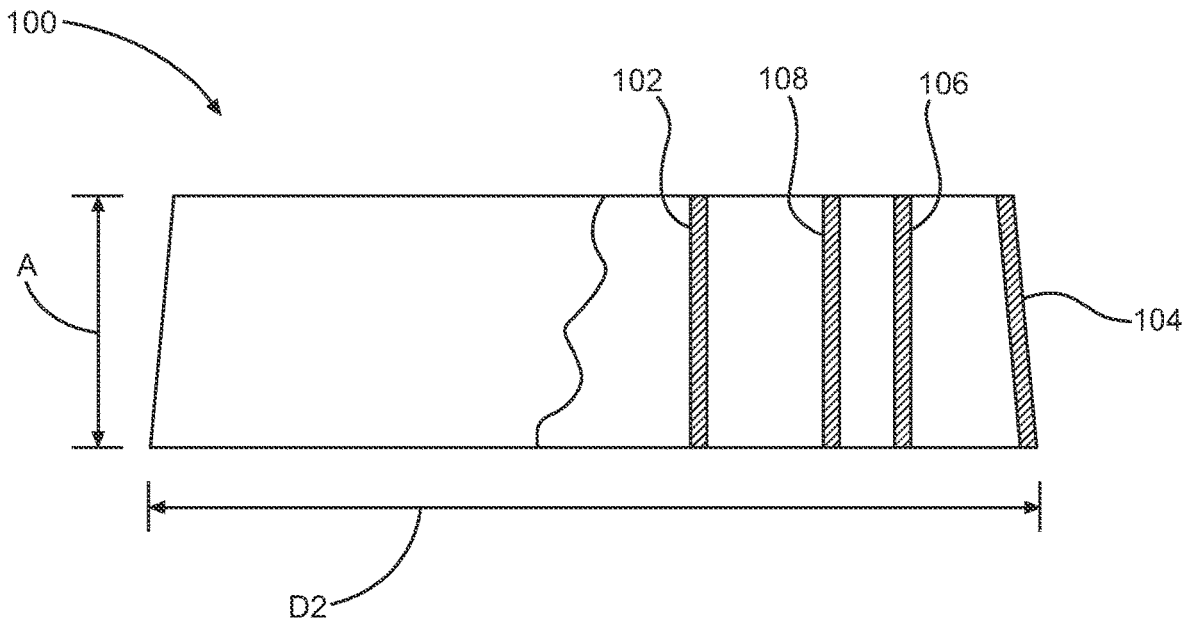
FIG. 4A is a partial cross section of FIG. 4 with vanes removed for clarity.

As shown in FIGS. 4 and 4A, the particulate distributor 100 has an inner cylinder 102, an outer cylinder 104 concentric with the inner cylinder 102, and an intermediate cylinder 106 concentric with both the inner cylinder 102 and the outer cylinder 104. There can be more than one intermediate cylinder 106. In this embodiment only the outer cylinder 104 is tapered. A first flow channel 110 is defined between the inner cylinder 102 and the intermediate cylinder 108, the first flow channel 110 having a first cross-sectional flow area. A second flow channel 112 is defined between the intermediate cylinder 106 and the outer cylinder 104, the second flow channel 112 having a second cross-sectional flow area. In certain implementations with only one intermediate wall, there will be only two flow channels. As illustrated, there is a third flow channel 114 having a third cross-sectional flow area between intermediate cylinders 106 and 108. The cross-sectional areas of each flow section may be configured to be equal or may be configured to be different. The diameter of the distributor is on the order of 54 inches and the degree of taper is between 3 and 5 degrees. The radial spacing between concentric cylinders and the length of a plate member 122 is on the order of five inches but these dimensions are given by way of example only and may vary according to the capacity of the mill/crusher/pulverizer device in which the distributor is to be used.

The inner cylinder 102 is sized to friction fit around the coal inlet supply conduit 12. The outer cylinder 104 has an inlet diameter $D_2$ and an outlet diameter $D_1$, the inlet diameter $D_2$ being greater than the outlet diameter $D_1$. The outer cylinder 104 can gradually slope between the different diameters as illustrated in FIGS. 4 and 4A, forming a conical shape. The conical shape allows for maintenance access on mill isolation components. Further, the conical shape lowers the differential pressure across the distributor and improves flow of the air/coal particulate stream. As shown in FIGS. 1 and 2, the outlet supply conduit 14 can also be shaped such that the outer cylinder 104 is in contact with the outlet supply conduit 14 across its entire outer wall. Alternatively, the outlet supply conduit 14 may be vertical, with an inner diameter that allows the inlet diameter $D_2$ of the outer wall to just fit within the outlet supply conduit 14.

Figure 7:
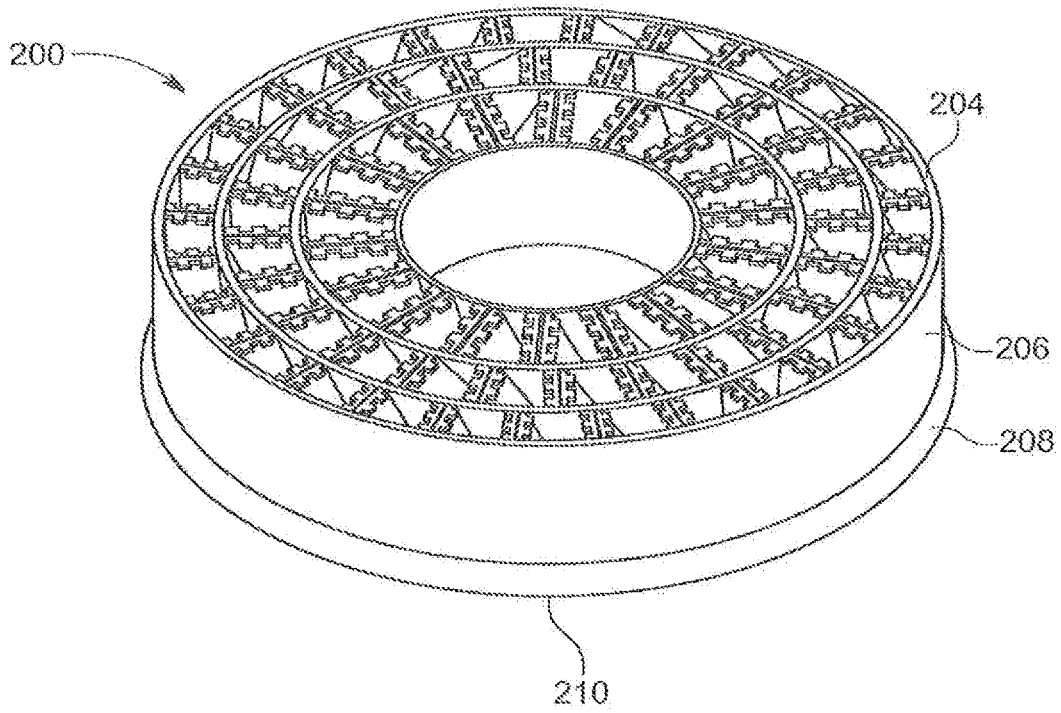
FIG. 7 is a perspective view of another implementation of a particulate distributor as disclosed herein.
Figure 8:
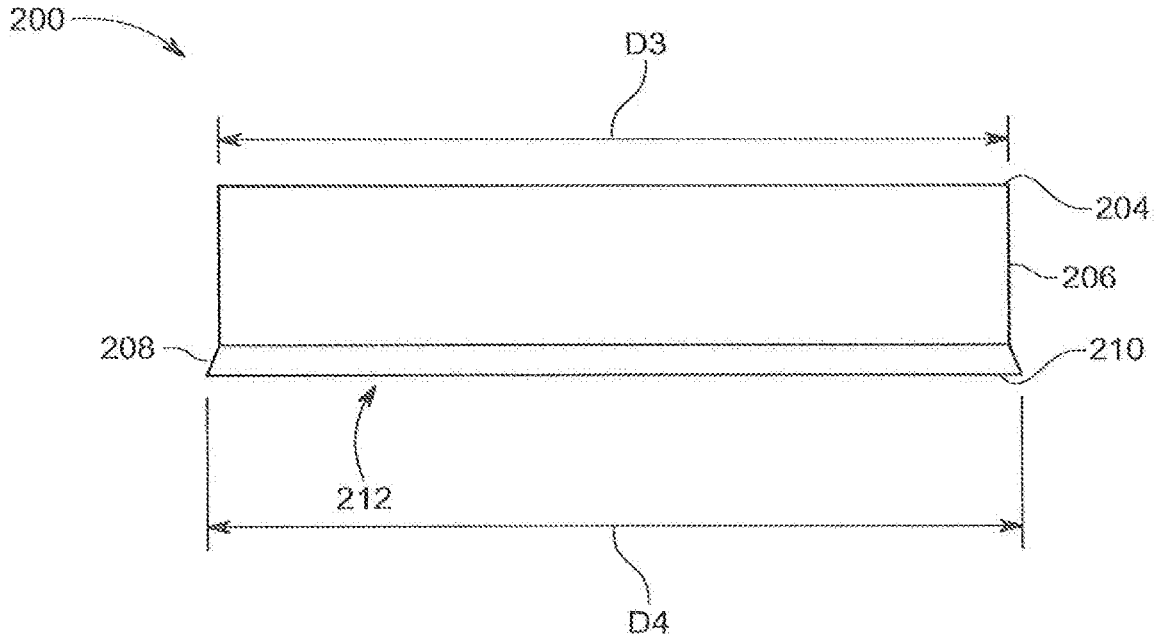
FIG. 8 is a side view of the implementation of the particulate distributor of FIG. 7.
Figure 10:
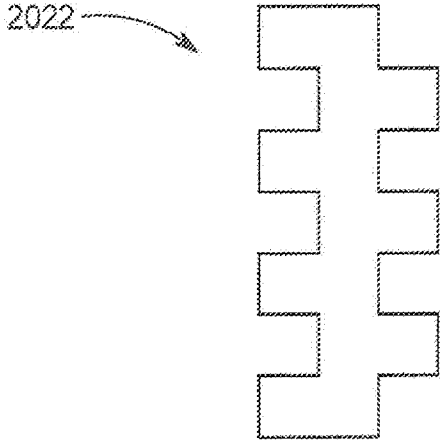
FIGS. 9-12 are plan views of varying implementations of members of an outlet distributor as disclosed herein.

Alternatively, as illustrated in FIGS. 7 and 8, a particulate distributor 200 may have an outer cylinder 204 with a vertical portion 206 having a first diameter $D_3$ and a flared portion 208 extending from the vertical portion 206 and having a second diameter $D_4$ at a distal end 210 of the flared portion 208, the second diameter $D_4$ greater than the first diameter $D_3$ and positioned at an inlet side 212 of the particulate distributor 200.

The particulate distributor 100 has a diffuser structure 120 comprising plate members 122 attached to the vanes at the outlet points 116 of the particulate distributor 100, the plate members 122 providing surface areas extending perpendicular to a longitudinal axis A of the flow channels in the distributor 100, the surface area extending into one or more of the first flow channel 110, the second flow channel 112, and the third flow channel 114. The plate members 122 are configured to reduce the cross-sectional flow area of a flow channel at the outlet point 116.

Figure 3:
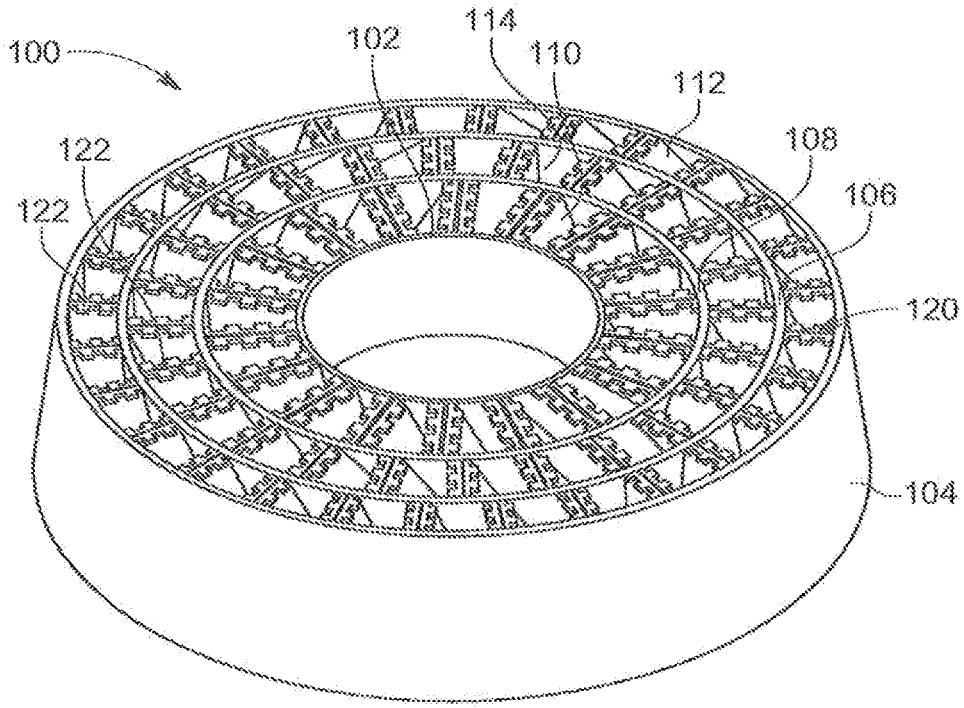
FIG. 3 is a perspective view of an implementation of a particulate distributor as disclosed herein.

The structure 120 shown in FIG. 3 includes dentillated plate members 122 of high abrasion resistant material welded into the inside surfaces of the vanes of the distributor 100 directly at the outlet points so as to extend radially across the vaned flow paths and partially circumferentially into the paths between the concentric cylinders. The plates are long enough to extend fully between the cylindrical walls of the adjacent concentric cylinder as shown.

Figure 6:
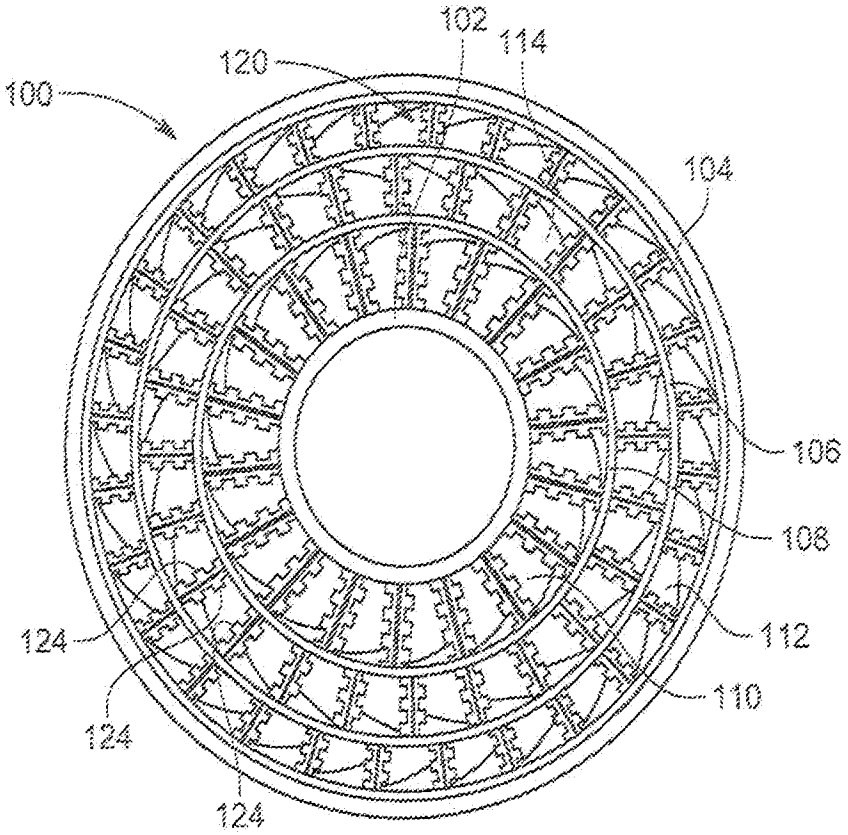
FIG. 6 is a plan view of an outlet side of the implementation of the particulate distributor of FIG. 3.
Figure 12:
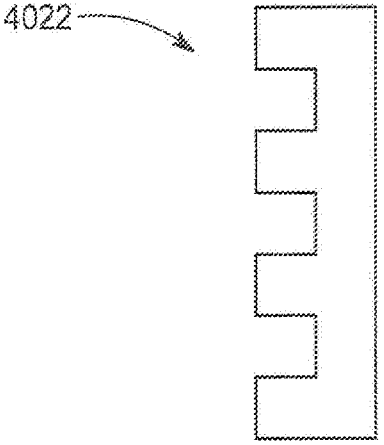
Figure 9:
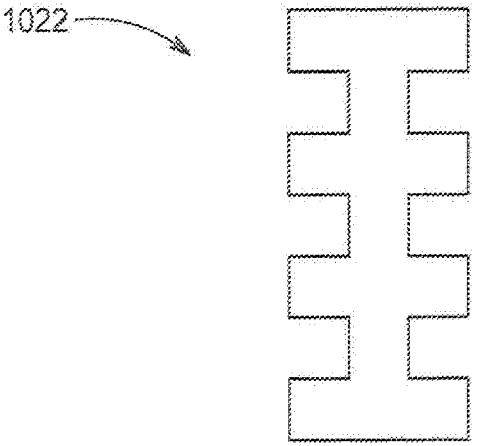
Figure 11:
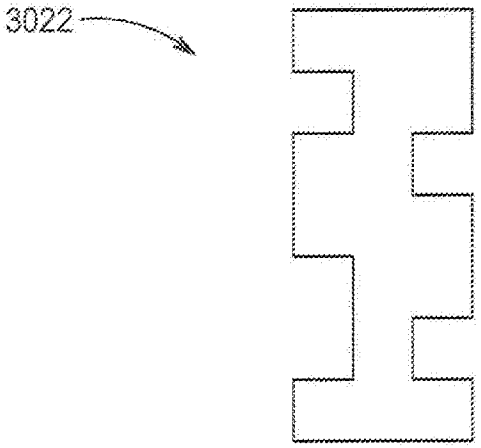

The plate members 122 are shown in FIGS. 3 and 6 to take the form shown in FIG. 12; i.e. with evenly spaced apart teeth. The plates are preferably made of an abrasion resistant material such as high carbon AR 400 steel where hard coal is being used in the mill/crusher/pulverizer. Milder steel such as A6 can be used with softer less abrasive coal. The plates may also be coated with a plating material such as chromium carbide. Other approaches to providing abrasion resistance will be apparent to those skilled in abrasion protection metallurgy.

As noted, a functional aim of the outlet structure 120 is to reduce the cross-sectional flow area of each flow channel by providing plate members 122 which partially obstruct the flow channel, the particulate coal impinging on the plate surfaces, resulting in better mixing, dispersion and particulate size. The actual shape of the members 122 of the outlet structure 120 is not limited to that shown in FIGS. 3-6. FIGS. 9-12 provide further examples of double-sided members 1022, 2022 and 3022 and a one sided member 4022, respectively, with teeth of varying number and size. It is noted that the teeth should be of a size that can withstand the force of the impact on them from the entrained coal particles and of a size to provide sufficient area to encourage impingement while not restricting the flow through the channels to a negative degree.

Figure 5:
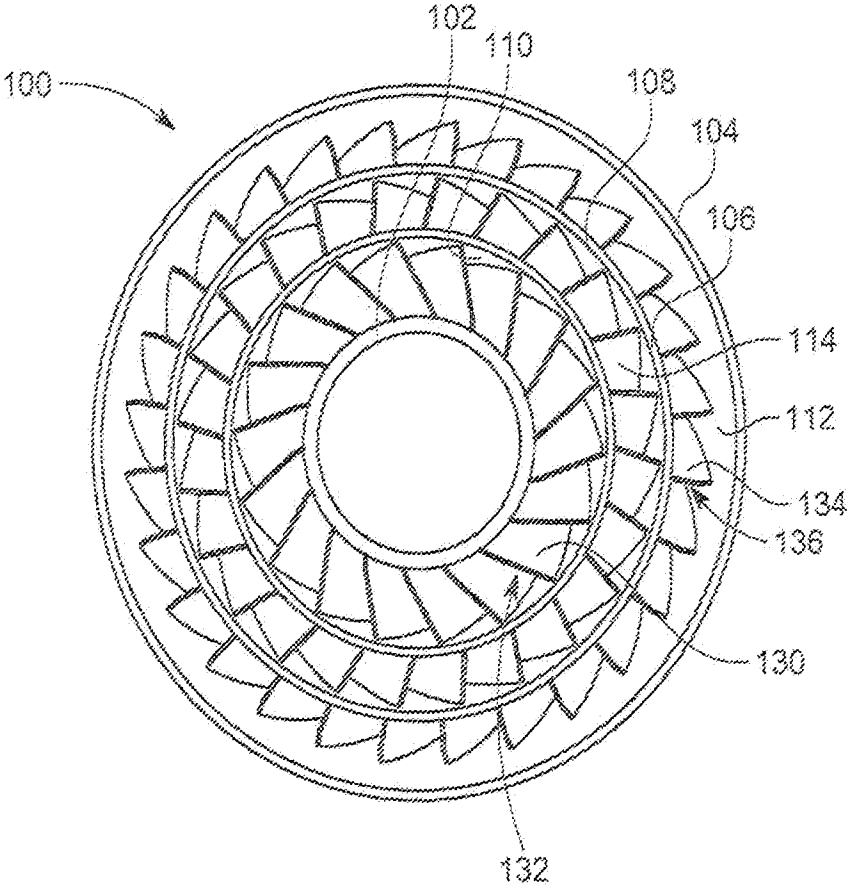
FIG. 5 is a plan view of an inlet side of the implementation of the particulate distributor of FIG. 3.
Figure 13:
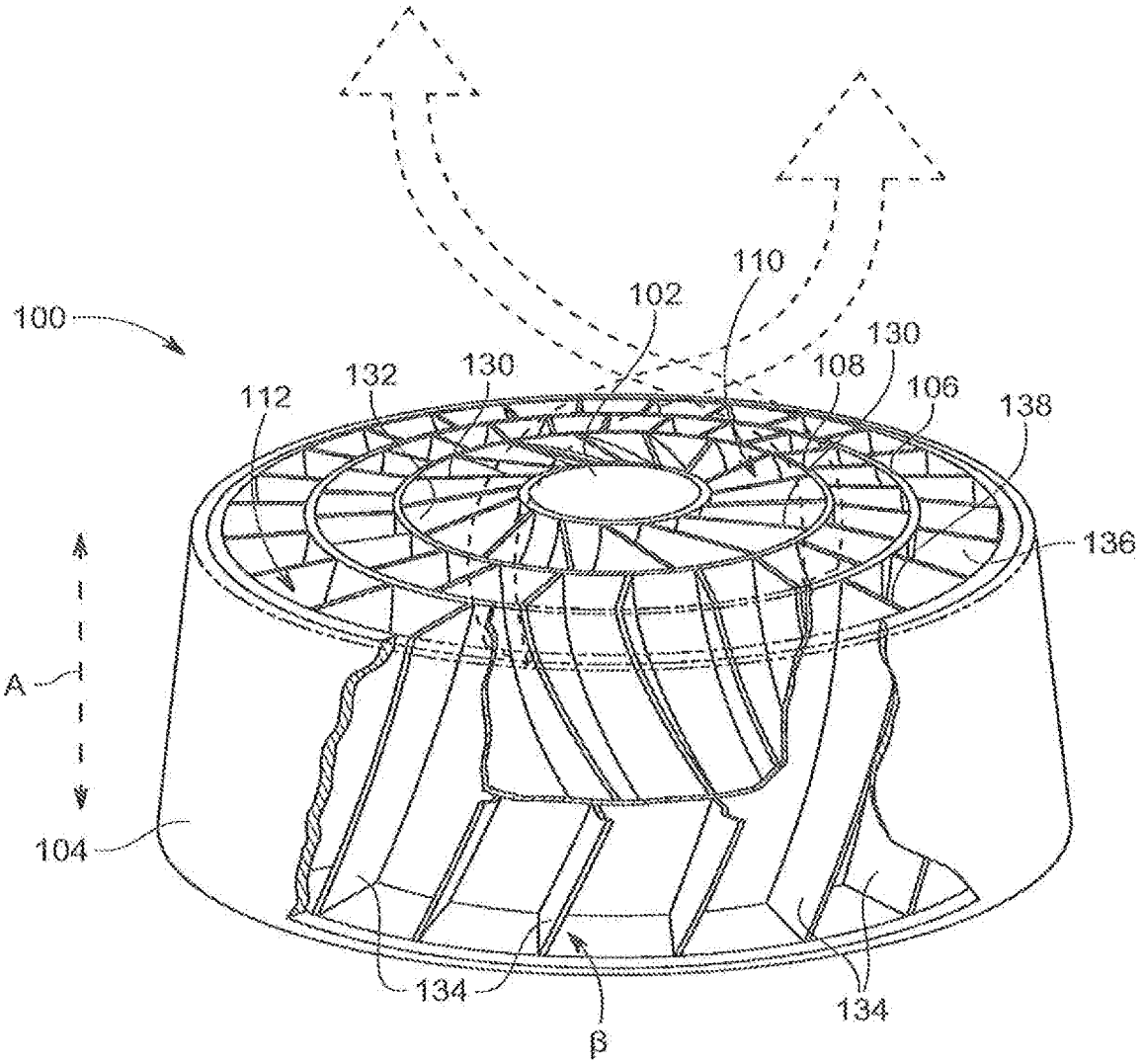
FIG. 13 is a cutaway of an implementation of a particulate distributor with the outlet distributor removed for view of the vanes.

As illustrated in FIGS. 5 and 13, the first flow channel 110 can have first vanes 130 each extending between and attached to the inner cylinder 102 and the intermediate cylinder 108. There may be any number of first vanes 130. The first vanes 130 divide the first flow channel 110 into first flow subdivisions 132. The first flow subdivisions 132 can be of equal areas as illustrated for can be divided so as to be varying areas. The second flow channel 112 can have second vanes 134 each extending between and attached to the outer cylinder 104 and the intermediate cylinder 106. The second vanes 134 divide the second flow channel 112 into second flow subdivisions 136. The second flow subdivisions 136 can be of equal areas as illustrated for can be divided so as to be varying areas. Any intermediate flow channel, such as third flow channel 114, can also have vanes dividing the flow channel into flow subdivisions. The first vanes 130 and second vanes 134 can be configured vertically or at an angle. For example, as seen in FIG. 13, the first vanes 130 may be oriented to form a first angle with the longitudinal axis A of the particulate distributor 100 to rotate flow in a first direction and the second vanes 134 may be oriented to form a second angle β with the longitudinal axis A of the particulate distributor 100 to rotate flow in a second opposite direction. FIG. 13 is showing the particulate distributor 100 without the outlet strucure 120 for clarity.

The diffuser structure 120 can be attached to one or more first vanes 130 and one or more second vanes 134 at an outlet edge 138 of the one or more first vanes 130 and the one or more second vanes 134. The diffuser structure 120 may have members 122 associated with each vane in each flow channel such that a total number of vanes equals a total number of members 122, may have a member 122 associated with each vane in only one or less than all of the flow channels, may have a member 122 associated with only a portion of the vanes in each of the flow channels, or may have a member 122 associated with only a portion of vanes in one or less than all of the flow channels. All members 122 may have teeth 126 formed therein on both opposed longitudinal edges 124 extending in both adjacent flow subdivisions. All members 122 may have teeth 126 on only one longitudinal edge 124 extending into only one adjacent flow subdivision. Members 122 may have a combination of teeth 126 on both longitudinal edges 124 and teeth 126 on only one longitudinal edge 124. All teeth 126 may be of the same shape and size or may be all of the same size but varying shape or may be all of the same shape and varying size. The outlet structure 120 may reduce cross-sectional flow areas of the flow channels each by equal amounts or by different amounts. As illustrated in the figures, an implementation of the outlet structure 120 has members 122 extending radially along an entire distance between and in relation to the inner cylinder 102 and the intermediate cylinder 106, members 122 extending radially along an entire distance between intermediate cylinder 106 and intermediate cylinder 108, and members 122 extending radially along an entire distance between intermediate cylinder 108 and outer cylinder 104. The outlet structure 120 has a member 122 associated (e.g., aligned) with each vane in each of the first flow channel 110, the second flow channel 112 and the third flow channel 114. Each plate member 122 has teeth 126 along each longitudinal edge 124.

Persons skilled in the art will understand that the various embodiments of the disclosure described herein and shown in the accompanying figures constitute non-limiting examples, and that additional components and features may be added to any of the embodiments discussed herein above without departing from the scope of the present disclosure. Additionally, persons skilled in the art will understand that the elements and features shown or described in connection with one embodiment may be combined with those of another embodiment without departing from the scope of the present disclosure and will appreciate further features and advantages of the presently disclosed subject matter based on the description provided. The preferred implementation is shown in FIGS. 3 and 4 to combine the use of the dentillated plate members 122 with plates with a tapered distributor shape. The variations, combinations, and/or modifications to any of the embodiments and/or features the embodiments described herein that are within the abilities of a person having ordinary skill in the art are also within the scope of the disclosure, as are alternative embodiments that may result from combining, integrating, and/or omitting features from any of the disclosed embodiments. By way of example, the overall diameter of the distributor 100 shown in FIG. 5 is 54 inches, the inner diameter of the center opening about 18 inches and the radial spacing between the concentric cylinders is about 5 inches. Likewise, the length of the plate member 4022 shown in FIG. 12 is about 5 inches. Therefore, each tooth and each space between teeth is about 0.71 inches. The dimensions of the plates shown in FIGS. 9, 10 and 11 can be determined by comparison with FIG. 12.

Use of broader terms such as "comprises," "includes," and "having" should be understood to provide support for narrower terms such as "consisting of," "consisting essentially of," and "comprised substantially of." Accordingly, the scope of protection is not limited by the description set out above but is defined by the claims that follow and includes all equivalents of the subject matter of the claims.

Although terms such as "first," "second," "third," etc., may be used herein to describe various operations, elements, components, regions, and/or sections, these operations, elements, components, regions, and/or sections should not be limited by the use of these terms in that these terms are used to distinguish one operation, element, component, region, or section from another. Thus, unless expressly stated otherwise, a first operation, element, component, region, or section could be termed a second operation, element, component, region, or section without departing from the scope of the present disclosure.

Each and every claim is incorporated as further disclosure into the specification and represents embodiments of the present disclosure. Also, the phrases "at least one of A, B, and C" and "A and/or B and/or C" should each be interpreted to include only A, only B, only C, or any combination of A, B, and C.

What is claimed is:

1. A particulate distributor for pulverized coal flowing to a combustion chamber, the particulate distributor comprising:

an inner cylinder;

an outer cylinder concentric with the inner cylinder;

an intermediate cylinder concentric with the inner cylinder;

a first flow channel defined between the inner cylinder and the intermediate cylinder, the first flow channel having first vanes each extending between and attached to the inner cylinder and the intermediate cylinder to divide the first flow channel into first flow subdivisions;

a second flow channel defined between the intermediate cylinder and the outer cylinder, the second flow channel having second vanes each extending between and attached to the outer cylinder and the intermediate cylinder to divide the second flow channel into second flow subdivisions;

a diffuser structure attached to at least some of the vanes in the distributor structure, the diffuser structure being configured to reduce a cross-sectional area of each of the first flow subdivisions and the second flow subdivisions at an outlet side; and wherein said diffuser structure comprises a plurality of abrasion resistant plate members, wherein each plate member has opposed longitudinal edges extending radially in relation to the inner cylinder and having spaced apart teeth formed in at least one of the opposed longitudinal edges to provide an impingement surface extending between the opposed longitudinal edges and into at least one adjacent first flow subdivision or adjacent second flow subdivision.

2. The particulate distributor of claim 1, wherein the opposed longitudinal edges each have the teeth formed therein and the impingement surface of a respective member extends into both adjacent first flow subdivisions or both adjacent second flow subdivisions.

3. The particulate distributor of claim 1, wherein the outer cylinder has an inlet diameter and an outlet diameter, the inlet diameter being greater than the outlet diameter.

4. The particulate distributor of claim 1, wherein the outer cylinder has a vertical portion having a first diameter and a flared portion extending from the vertical portion and having a second diameter at a distal end of the flared portion, the second diameter greater than the first diameter and positioned at an inlet side of the particulate distributor.

5. The particulate distributor of claim 1, wherein:

the first vanes are oriented to form a first angle with a longitudinal axis of the particulate distributor to direct flow in a first direction; and the second vanes are oriented to form a second angle with the longitudinal axis of the particulate distributor to direct flow in a second direction.

6. A conical fuel particulate distributor for pulverized coal flowing to a combustion chamber, the particulate distributor comprising:

an inner cylinder;

an outer cylinder concentric with the inner cylinder;

an intermediate cylinder concentric with the inner cylinder;

a first flow channel defined between the inner cylinder and the intermediate cylinder, the first flow channel having first vanes each extending between and attached to the inner cylinder and the intermediate cylinder;

a second flow channel defined between the intermediate cylinder and the outer cylinder, the second flow channel having second vanes each extending between and attached to the outer cylinder and the intermediate cylinder; and an outlet structure attached at an outlet side of the particulate distributor, comprising:

a number of plate members, each member aligned with an outlet edge of a respective first vane or a respective second vane and comprising:

opposed longitudinal edges having teeth formed therein, the teeth extending into one of the first flow channel or the second flow channel and forming an impingement surface configured to reduce a cross-sectional area of each of the first flow channel and the second flow channel.

7. The particulate distributor of claim 6, wherein the number of members is less than a total of a number of the first vanes and a number of the second vanes.

8. The particulate distributor of claim 6, wherein the outer cylinder has an inlet diameter and an outlet diameter, the inlet diameter being greater than the outlet diameter, thus forming a conical shape.

9. The particulate distributor of claim 6, wherein the outer cylinder has a vertical portion having a first diameter and a flared portion extending from the vertical portion and having a second diameter at a distal end of the flared portion, the second diameter greater than the first diameter and positioned at an inlet side of the particulate distributor.

10. The particulate distributor of claim 6, wherein:

the first vanes are oriented to form a first angle with a longitudinal axis of the particulate distributor to direct flow in a first direction; and the second vanes are oriented to form a second angle with the longitudinal axis of the particulate distributor to direct flow in a second direction.

* * * * *